United States Patent [19]

Hakim

[11] 4,312,293

[45] Jan. 26, 1982

[54] FLOCKING APPARATUS

[76] Inventor: Salomón Hakim, Carrera 13, N. 48-26, Bogota, Columbia

[21] Appl. No.: 186,667

[22] Filed: Sep. 12, 1980

[51] Int. Cl.[3] ..... B05C 11/00; B05B 5/02

[52] U.S. Cl. ..... 118/697; 118/44; 118/63; 118/621

[58] Field of Search ..... 427/264, 348; 118/44, 118/697, 696, 63, 621

[56] References Cited

U.S. PATENT DOCUMENTS 3,908,542 9/1975 Andersson ..... 118/697 X

*Primary Examiner*—Bernard D. Pianalto

*Attorney, Agent, or Firm*—Kenway & Jenney

[57] ABSTRACT

Disclosed is an apparatus for reproducing patterns on flocked material. The pattern to be reproduced is scanned as a sequence of lines. For each line, the reflected light intensity is measured as a function of the position along the scanned line. This information is then used to control an air jet for selectively deflecting from the perpendicular the flocking fibers thereby to reproduce the desired pattern.

15 Claims, 6 Drawing Figures

FLOCKING APPARATUS

BACKGROUND OF THE INVENTION

This invention relates to apparatus and method for making flocked materials and, more particularly, to such apparatus and method for producing patterned flocked materials.

Flocked materials are often used for decorative purposes, such as for decorative wall coverings. These materials typically feature a backing material onto which fibers standing on end are attached adhesively. These erect fibers give the material a textured, velvety appearance. Such materials are typically made by first coating a backing material with an adhesive. Short fibers are then applied to the backing material. Of course, if the fibers were simply allowed to fall onto the backing material, they would have no preferred orientation. In fact, most them would lie on their side. In order that the fibers stand up on the backing material, it is known to envelop the backing material within an electrostatic field whose lines of force are substantially perpendicular to the backing material. Because of the field, as the fibers drop onto the backing material, they will align themselves with the field and so stick to the backing material oriented substantially perpendicularly to the backing material. After the fibers have been so deposited onto the backing material, the adhesive is caused to set as by passing the backing material with the attached fibers through an oven. This process thus results in a uniformly flocked material.

It is also known to create patterned flocked materials by putting adhesive on the backing material only where it is desired that the fibers stick. After the adhesive is laid out in the desired pattern, the fibers are applied to the backing material and the adhesive allowed to set. Thereafter, the excess fibers are removed since only those fibers in contact with the adhesive will stick to the backing material. The patterned flocked material produced in this way, however, is limited in complexity of design since the material either will have fibers or have no fibers at all. Thus, the patterns that can be achieved in this manner are rather simple, usually limited to simple geometric shapes.

It is an object of the present invention, therefore, to provide an apparatus and method for reproducing complex patterns on a flocked material. It is a further object of this invention to provide such apparatus which is capable of producing patterns preserving a wide gray scale range of contrasts.

SUMMARY OF THE INVENTION

The apparatus according to the present invention for producing a patterned flocked material comprises apparatus for supporting a backing material which has been coated on one side with an adhesive. An assembly is provided for applying onto the adhesive coated side of the backing material fibers oriented substantially perpendicularly to the backing material. Apparatus is then provided for generating signals representing the pattern which is to be reproduced on the flocked material. An air jet modulating assembly next selectively deflects the fibers away from the perpendicular as a function of the signals which represent the pattern to be reproduced. Because the deflected fibers interact with the reflect light differently according to the extent of their deflection from the perpendicular, a range of contrasts can be achieved allowing the pattern to be reproduced with substantial fidelity. Finally, heating apparatus hardens the adhesive, thereby preserving the pattern on the flocked material.

In a preferred embodiment, the means for applying the fibers so that they are oriented substantially perpendicularly to the backing material features an electrostatic field encompassing the backing material. The lines of force of this field are oriented substantially perpendicularly to the backing material so that the fibers align themselves substantially perpendicularly to the backing material. In this embodiment, the means for generating the signals representing the pattern to be reproduced features scanning the pattern in a sequence of lines which cover the pattern, and generating for each line scanned a signal representing the reflected light intensity as a function of position along the line.

The air jet of this embodiment is controlled by moving the air jet in a line across the fiber-coated side of the backing material and modulating the mass flow rate of air from the air jet along the line as a function of the signal generated for that line from the pattern to be reproduced. In this embodiment, the mass flow rate of air from the air jet is modulated by an electrically operated valve such as a solenoid. The backing material support is adapted for incrementally advancing the material in a direction perpendicular to the direction of motion of the air jet across the backing material, thereby allowing the pattern to be reproduced line by line on the flocked material. It is preferred that the mass flow rate from the air jet be proportional to the signal generated at each point across the line of the pattern to be reproduced. For achieving surrealistic effects, the mass flow rate may be made inversely proportional to the signal at each point across the line being scanned. Or to produce still further effects, the gray scale can be compressed so that the mass flow rate of air from the air jet has a first value for levels of the recorded signal below a threshold value and a second value for levels of the signal above the threshold value. A suitable means of generating the signals representing the pattern to be reproduced includes a photosensitive element adapted to generate a signal proportional to the reflected light intensity at each point along the scanned lines. Alternatively, the signals representing the pattern to be reproduced can be generated by a slow scanning television camera and its related equipment. An oven through which the material passes is the preferred method of setting the adhesive, thereby preserving the pattern in the flocked material.

BRIEF DESCRIPTION OF THE DRAWINGS

The invention disclosed herein will be better understood with reference to the following drawing of which.

DESCRIPTION OF THE PREFERRED EMBODIMENT

Figure 1:
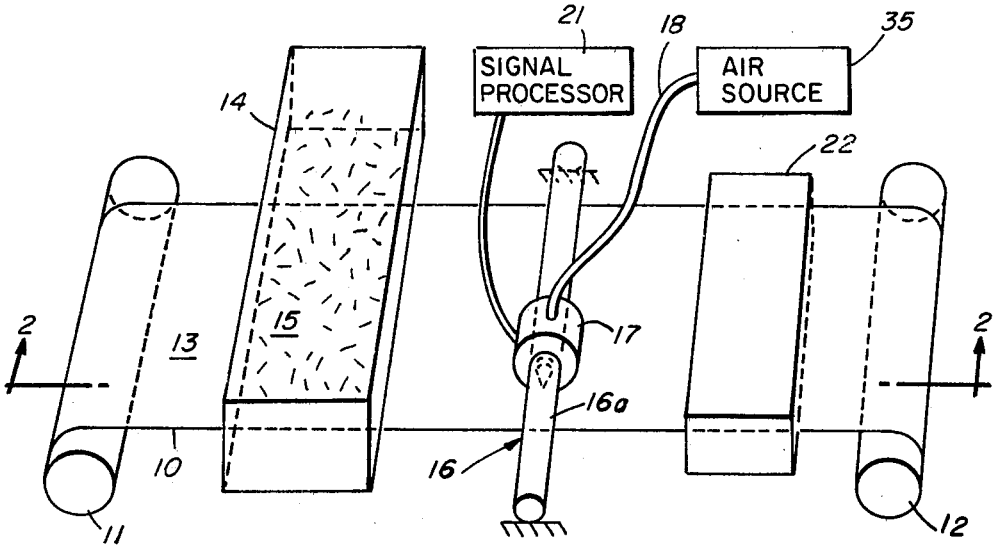
FIG. 1 is a perspective view of the apparatus for producing patterned flocked materials.

Referring first to FIG. 1, a backing material 10 is supported between a supply roll 11 and a take-up roll 12. A suitable backing material is a heavy grade of paper on cloth as conventionally used for wall coverings. A top surface 13 of the backing material 10 is coated with an adhesive for receiving the fibers to make a flocked material. The rolls 11 and 12 are driven by conventional electrical motor means (not shown) so that the backing material can be advanced incrementally as required to reproduce a pattern on the backing material 10, as will become clear in what follows. The material 10 first passes beneath a fiber reservoir 14 which contains short lengths of textile fibers 15. The bottom of the reservoir 14 is perforated so as to allow the fibers 15 to fall onto the adhesive-coated surface 13. As can be seen more clearly in FIG. 2, the backing material 10 and the reservoir 14 are disposed between metallic plates 30 and 31. The plate 30 is maintained at a positive potential, while the plate 31 is maintained at a negative potential, thereby creating electrostatic field lines running substantially perpendicularly to the backing material 10. A suitable potential difference is 50 kilovolts. Thus electrostatic field causes the fibers 15 falling from the reservoir 14 onto the backing material 10 to align themselves with the field, so that they land on the backing material oriented substantially perpendicularly to the backing material 10.

Figure 2:
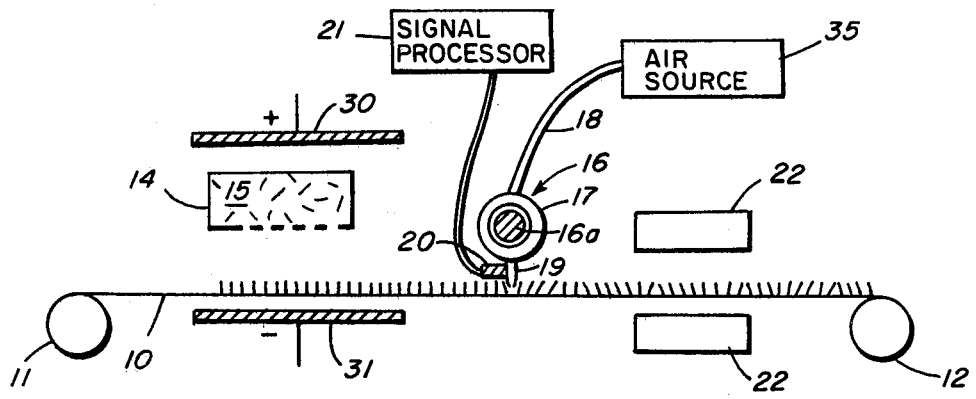
FIG. 2 is a cross-sectional view along section line 2—2 of FIG. 1.

Referring now both to FIGS. 1 and 2, the backing material 10 passes beneath the reservoir 14 and then to an air jet assembly 16. The air jet assembly 16 features a rigidly fixed rod 16*a* which slidably supports a manifold 17. The position of the manifold 17 along the rod 16*a* is closely regulated by conventional means (not shown) such as is known in the automatic plotting apparatus art.

A source of pressurized air 35 supplies the manifold 17 by means of a flexible hose 18. As can be seen in FIG. 2, the manifold 17 communicates with a nozzle 19 which is positioned closely above the backing material 10. The flow of air through the nozzle 19 is controlled by means of a solenoid valve 20. The solenoid valve 20 allows the orifice area of the nozzle 19 to be continuously varied for modulating the flow of air through the nozzle 19. The solenoid 20 is controlled by a conventional signal processing means 21.

Figure 3:
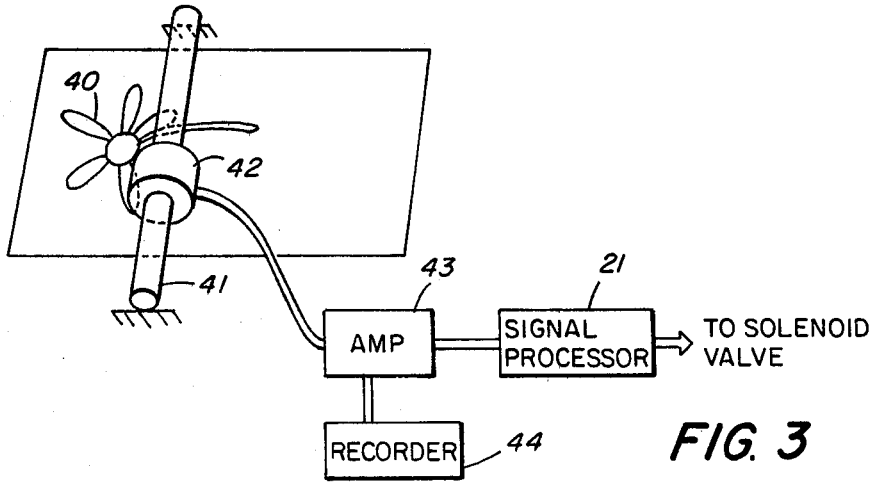
FIG. 3 is a diagrammatic representation of a preferred pattern scanning system.

With reference next to FIG. 3, the pattern to be reproduced on the flocked material is represented by a flower 40. The flower pattern 40 is supported for incremental movement beneath a fixed rod 41 so that it can be scanned as a sequence of lines. It is to be noted that the pattern 40 could remain stationary while the rod 41 moves incrementally to effect line-by-line scanning. Slidingly mounted on the rod 41 is a photosensitive assembly 42 whose position along the rod 41 is controlled accurately by conventional means (not shown), for example, as known in the automatic plotting art. The photosensitive assembly 42 is adapted for generating an output signal proportional to the reflected light intensity at each point along the line being scanned. The output signal from the photosensitive assembly 42 proceeds next to the input to an amplifier 43 and then to the signal processor 21. The signal processor 21 synchronizes the motion of the photosensitive assembly 42 along the rod 41 with the motion of the manifold 17 along the rod 16*a* (FIG. 1), taking into account any differences in scale factor between the pattern 40 and its representation on the flocked material 10. That is, the signal processor 21 is adapted for adjusting the size of the pattern as reproduced on the flocked material.

Figure 3A:
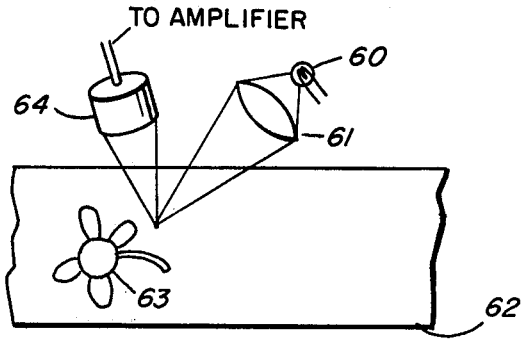
FIG. 3*a* is a diagrammatic view of an arrangement for detecting reflected light from a pattern to be reproduced.
Figure 3B:
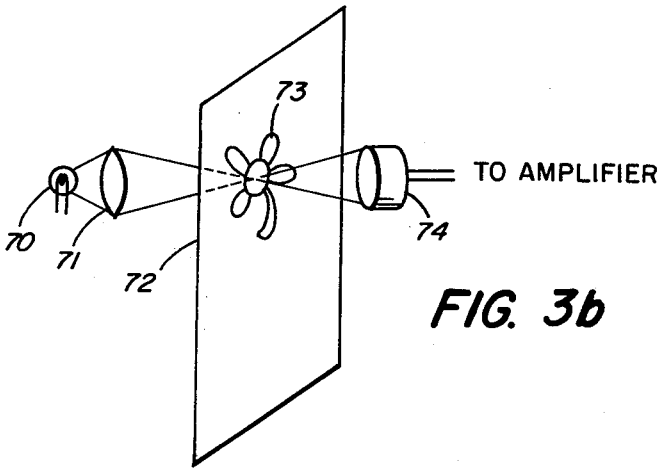
FIG. 3*b* is a diagrammatic representation of an arrangement for detecting light transmitted through a transparency.

The photosensitive assembly 42 of FIG. 3 may include a source of illumination with associated optics in addition to a photocell. FIG. 3*a* shows such an arrangement. In particular, light from a source 60 is focused by a lens 61 onto the medium 62 supporting the pattern 63 to be impressed on a flocking material. A photocell 64 is disposed for receiving the light reflected from the medium 62. It is to be understood that FIG. 3*a* is merely diagrammatic; the light source 60, lens 61 and photocell 64 are mounted conventionally for motion as a unit for scanning the pattern 63. FIG. 3*b* represents diagrammatically an arrangement for scanning a pattern supported on a transparent medium. A light source 70 illuminates a lens 71 which focuses the light onto a transparent medium 72. The medium 72 includes a pattern 73 to be reproduced. The light from source 70 passes through the medium 72 and impinges upon a photocell 74. As in FIG. 3*a*, it is to be understood that the source 70, lens 71 and photocell 74 are arranged to move as a unit for scanning the transparent medium 72 or, alternatively, are fixed and the medium 72 arranged for raster scanning motion.

As illustrated in FIG. 3, the signal from the amplifier 43 may be recorded by a recorder 44, such as a conventional cassette tape recorder. Once the reflected light intensity information from the pattern 40 has been recorded, the flocking apparatus disclosed herein may be operated with this recorded information. Thus, the pattern to be reproduced need not be scanned simultaneously with the flocking operation itself.

The signal processor 21 controls the solenoid valve 20 (FIG. 2). For each point along the rod 16*a* the signal processor 21 commands a particular opening of the solenoid valve 20 which controls the mass flow rate of air through the nozzle 19. In this embodiment, the mass flow rate as commanded by the signal processor 21 is directly proportional to the signal from the photosensitive assembly 42 or the recorder 44 which represents the amount of light reflected from the corresponding part of the pattern 40 to be reproduced. That is, the brightest part of the flower pattern 40 will cause the highest level output signal from the photosensitive assembly 42. Corresponding to this high level output, the signal processor 21 will command a large valve 20 opening, thereby generating a large mass flow rate of air through the nozzle 19 which will deflect the fibers 15 away from their substantially perpendicular orientation. Similarly, the darker areas of the flower pattern 40 will cause the photosensitive element 42 to generate a smaller signal. The signal processor 21 will then command a smaller opening for the valve 20, thereby diminishing the mass flow rate. This reduced air flow rate deflects the fibers 15 away from their perpendicular orientation by an amount smaller than that corresponding to a higher flow rate. The signal processor 21 is also adapted to effect an inversion, so that the lightest areas in the pattern to be reproduced will cause the smallest amount of air to flow through the nozzle 19, and the darkest areas will cause the greatest mass flow rate through the nozzle 19 thereby to produce an artistic effect on the flocked material. Additionally, the signal processor 21 is adapted to compress the gray scale so that only two levels of signals emerge from the signal processor 21. For example, areas on the flower pattern 40 which are brighter than a threshold level will cause the signal processor 21 to command one valve 20 opening and those areas less bright than the threshold will cause another level of valve 20 opening. Such a scheme will result in a representation in the flocked material of the flower pattern 40 which has very high contrast.

After each line has been reproduced, the backing material 10 is advanced by a small increment and the manifold 17 is returned to its initial position along the rod 16*a*. The next line is then reproduced. This procedure continues until the whole pattern has been completed.

Figure 4:
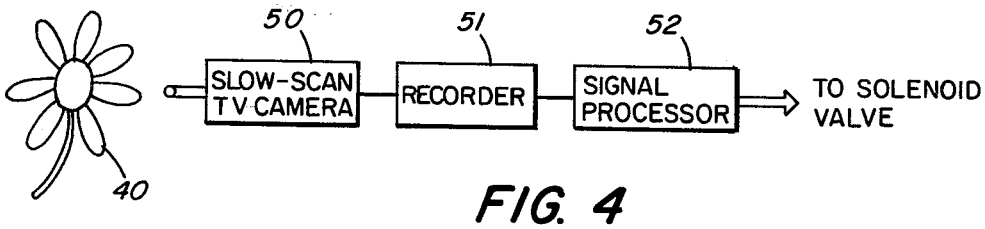
FIG. 4 is a block diagrammatic representation of an alternative pattern scanning system.

It is understood that other scanning procedures may be employed for generating the signals representing the reflected light intensity of the pattern to be reproduced. For example, optical means including lenses and mirrors may be used to focus and sweep a light beam across the pattern to effect a raster scan of the pattern. Suitably located photodetectors responsive to the reflected or transmitted light generate the signals for modulating the air flow which creates the patterned flocked material. In particular, a slow-scan television system may be adapted for such scanning. With reference to FIG. 4, the pattern to be reproduced on the flocked material is again represented by a flower 40. In this embodiment, the flower 40 is scanned line by line by a slow-scan television camera 50 and the output signals from the camera 50 are recorded by a conventional magnetic tape recorder 51. That is, the recorder 51 stores information concerning the intensity of the reflected light from the flower 40 for each of the raster lines scanned by the slow-scan television camera 50. For reproducing the flower pattern 40 onto the flocked material, the information in the recorder 51 proceeds to a signal processor 52 which controls both the solenoid valve 20 of FIG. 2 and also the position of the manifold 17 of FIG. 1 along the rod 16*a*.

Referring again to FIGS. 1 and 2, after the backing material 10 has passed beneath the nozzle 19 where the fibers 15 are selectively deflected line by line from the perpendicular thereby to create the desired pattern, the material passes through an oven 22 where the adhesive is hardened, thereby preserving the pattern in the flocked material 10. The backing material 10 is then wound upon the take-up roll 12.

It is to be understood that the exemplary flower pattern 40 in FIGS. 3, 3*a*, 3*b* and 4 can be reproduced on the backing material over and over, or different patterns can be reproduced at different locations on the backing material 10.

It is thus seen that the objects of this invention have been achieved in that there has been disclosed novel apparatus for reproducing patterns with high visual fidelity on a flocked material, suitable, for example, as a wall covering or for other decorative purposes. It is understood that modifications and variations of the invention disclosed herein will occur to those skilled in the art. It is intended that such modifications and variations fall within the scope of the appended claims.

What is claimed is:

1. Flocking apparatus for producing a pattern of fibers on a backing material comprising:

(1) means for supporting said backing material, said backing material coated on a first side with an adhesive;

(2) means for applying onto said first side of said backing material said fibers oriented substantially perpendicularly to said backing material;

(3) means for generating signals representing said pattern to be reproduced on said flocked material;

(4) an air jet; and (5) means for controlling said air jet to deflect selectively said fibers away from the perpendicular as a function of said signals representing said pattern.

2. The apparatus of claim 1 further including heating means to harden said adhesive.

3. The apparatus of claim 1, wherein said means for applying said fibers comprises an electrostatic field encompassing said backing material, the lines of force of said field oriented perpendicularly to said backing material.

4. The apparatus of claim 1 wherein said means for generating said signals comprises:

(1) means for scanning said pattern as a sequence of lines covering said pattern; and (2) means for generating for each line scanned a signal representing the reflected light intensity as a function of position along said line.

5. The apparatus of claim 4 wherein said means for controlling said air jet comprises:

(1) means for moving said air jet in a line across said first side of said backing material; and (2) means for modulating the mass flow rate of air from said air jet along said line as a function of said signal generated for said line.

6. The apparatus of claim 4 wherein said means for generating said signals comprises a photosensitive element adapted to generate a signal proportional to said reflected light intensity at each point along said scanned lines.

7. The apparatus of claim 5 wherein said means for supporting said backing material is adapted for incrementally advancing said material in a direction perpendicular to the direction of motion of said air jet across said backing material.

8. The apparatus of claim 5 wherein said means for modulating the mass flow rate of air from said air jet comprises an electrically operated valve.

9. The apparatus of claim 8 wherein said valve is controlled by a solenoid.

10. The apparatus of claim 5 wherein said mass flow rate is proportional to said signal at each point across said line.

11. The apparatus according to claim 5 wherein said mass flow rate is inversely proportional to said signal at each point across said line.

12. The apparatus of claim 5 wherein said mass flow rate has a first value for levels of said signal below a threshold and wherein said mass flow rate has a second value for levels of said of said signal above said threshold.

13. The apparatus of claim 2 wherein said heating means comprises an oven.

14. The apparatus of claim 4 wherein said signal generating means comprises a slow-scan television system.

15. Flocking apparatus for producing a pattern of fibers on a backing material comprising:

(1) means for supporting said backing material for incremental motion, said backing material coated on a first side with an adhesive;

(2) means for generating an electrostatic field encompassing said backing material, the lines of force of said field oriented substantially perpendicularly to said backing material;

(3) means for applying textile fibers onto said first side of said backing material, said fibers being oriented substantially perpendicularly to said backing material by the action of said electrostatic field;

(4) photosensitive element means for scanning said pattern as a sequence of lines, said photosensitive element means adapted to generate a signal proportional to the reflected light intensity at each point along said scanned lines;

(5) an air jet directed onto said first side of said backing material;

(6) means for moving said air jet in a line across said first side of said backing material;

(7) valve means for modulating the mass flow rate of air from said air jet in proportion to said signal representing said pattern at each point across said line, thereby to deflect selectively said fibers away from the perpendicular; and (8) oven means to harden said adhesive thereby to preserve said pattern on said flocked material.

* * * * *